US005996706A

United States Patent [19]

Gibbs

[11] Patent Number: 5,996,706

[45] **Date of Patent: *Dec. 7, 1999**

[54] GRADER CIRCLE AND BEAM ASSEMBLY

[75] Inventor: James Dennis Gibbs, Harrogate, Tenn.

[73] Assignee: CBJ. Plating and Machine of Tennessee, Harrogate, Tenn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/651,357

[22] Filed: May 22, 1996

[51] Int. Cl.[6] ..... E02F 3/12

[52] U.S. Cl. ..... 172/792; 172/796

[58] Field of Search ..... 172/781, 783–793, 172/796, 795, 797, 798

[56] References Cited

U.S. PATENT DOCUMENTS

| | | | |
|---|---|---|---|
| 2,333,988 | 11/1943 | Demond | 172/796 |
| 3,512,589 | 5/1970 | Ulrich | 172/796 |
| 3,634,648 | 1/1972 | Morris et al. | 219/125 R |
| 3,983,945 | 10/1976 | Hart et al. | 172/791 X |
| 3,989,112 | 11/1976 | Cole et al. | 172/796 |
| 4,004,641 | 1/1977 | Hendrickson | 172/781 |
| 4,015,669 | 4/1977 | Cole | 172/796 |
| 4,084,644 | 4/1978 | Cole et al. | 172/796 |
| 4,185,700 | 1/1980 | Atherton et al. | 172/796 |
| 4,279,312 | 7/1981 | Pyle | 172/797 X |
| 4,304,307 | 12/1981 | Anderson | 172/797 X |
| 4,340,119 | 7/1982 | MacDonald | 172/797 X |
| 4,930,582 | 6/1990 | Goss | 172/788 |

OTHER PUBLICATIONS

Catalog: "Caterpillar 14G Motor Grader", pp. 187–189, 192–196, Caterpillar Tractor Company, Peoria, IL.

Catalog: "Caterpillar 16G Motor Grader", pp. 100–100b, 168–168c, Caterpillar Tractor Company, Peoria, IL.

*Primary Examiner*—Victor Batson

*Attorney, Agent, or Firm*—Pitts & Brittian, P.C.

[57] ABSTRACT

A circle and beam assembly for a motor grader. The circle and beam assembly of the present invention includes a circle from which two beams extend wherein the beams are oppositely disposed. An opening is defined at the lower end of each beam. A hinge rod is received through the openings, and the hinge rod extends beyond each of the beams for receiving a grader blade thereon. The outer diameter of the hinge rod is slightly larger than the diameter of each opening. Each opening is heated to permit the hinge rod to slide therethrough such that upon cooling, the hinge rod is securely held.

3 Claims, 2 Drawing Sheets

GRADER CIRCLE AND BEAM ASSEMBLY

TECHNICAL FIELD

This invention relates to the field of grader circle assemblies for a motor grader and improvements thereto.

BACKGROUND ART

In the field of earthworking equipment, motor graders are used to move dirt and rock for example. A motor grader is generally comprised of a main frame with a dirigible wheel assembly at a front end, an operator's cab at a rear end thereof, and a traction chassis for the motor and power train behind the cab. A motor grader blade is suspended from the main frame by means of a circle and beam assembly. The circle rotates about a vertical axis and the motor controls the rotary motion of the circle. The grader blade is mounted to the circle via the beam assembly which is secured to the circle. The rotation of the circle changes the angle of the blade. Further, the blade is mounted on a horizontal axis so that it may be tipped with respect to the circle.

The conventional construction of the beam assembly exposes portions of the beam assembly to premature failure which is costly to repair and leaves the motor grader idle until repairs can be made or the circle and beam assembly is replaced. Specifically, the location where the blade is mounted to the circle and beam assembly is subject to premature failure.

Therefore, it is an object of the present invention to provide an improved circle and beam assembly which is configured to prevent premature failure.

It is another object of the present invention to provide an improved circle and beam assembly which replaces parts of a conventional circle and beam assembly.

SUMMARY

Other objects and advantages will be accomplished by the present invention which provides an improved circle and beam assembly for a motor grader. The improved circle and beam assembly of the present invention for a motor grader includes a circle from which two beams extend wherein the beams are oppositely disposed. An opening is defined at the lower end of each beam. A hinge rod is received through the openings, and the hinge rod extends beyond each of the beams.

BRIEF DESCRIPTION OF THE DRAWINGS

The above mentioned features of the invention will become more clearly understood from the following detailed description of the invention read together with the drawings in which.

DESCRIPTION OF PREFERRED EMBODIMENTS

Figure 3:
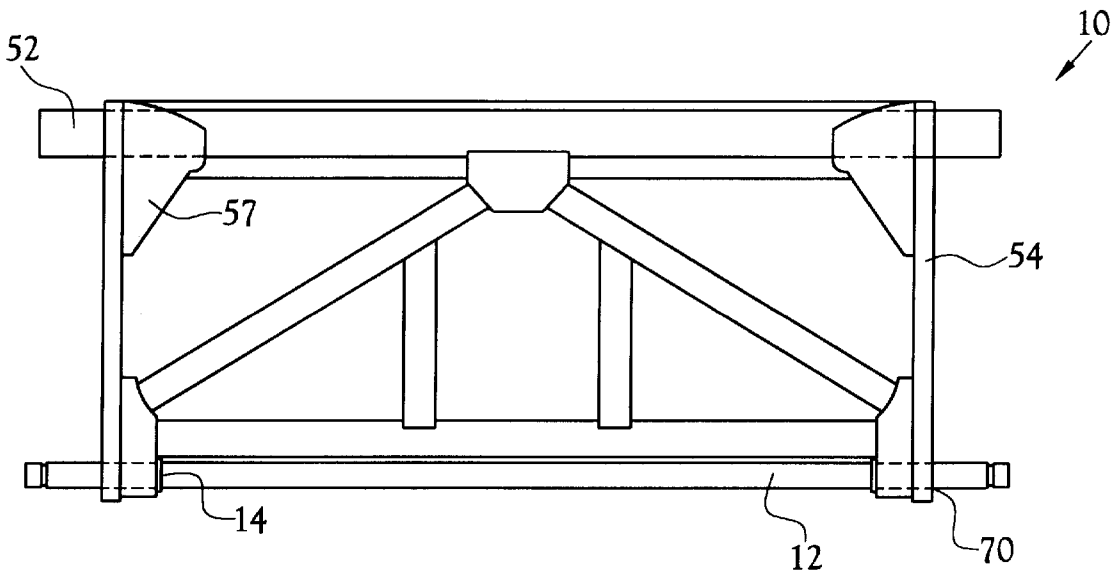
FIG. 3 illustrates an end view of the improved beam assembly of the present invention; and, FIG. 4 is a perspective view of the hinge rod of the present invention.

An improved grader circle and beam assembly incorporating various features of the present invention is illustrated generally at 10 in FIG. 3. The improved assembly 10 is designed to prevent premature failure of the assembly. Specifically, the improved assembly 10 is designed to prevent failure at the site at which the blade is mounted to the assembly 10.

Figure 1:
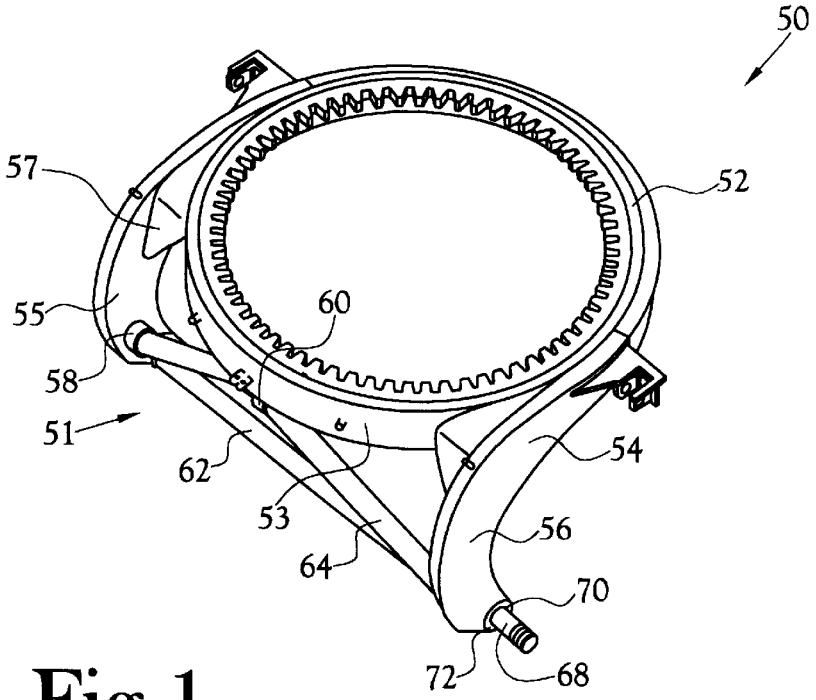
Fig. 1 (PRIOR ART)
FIG. 1 is a perspective view of a circle and beam assembly of the prior art.
Figure 2:
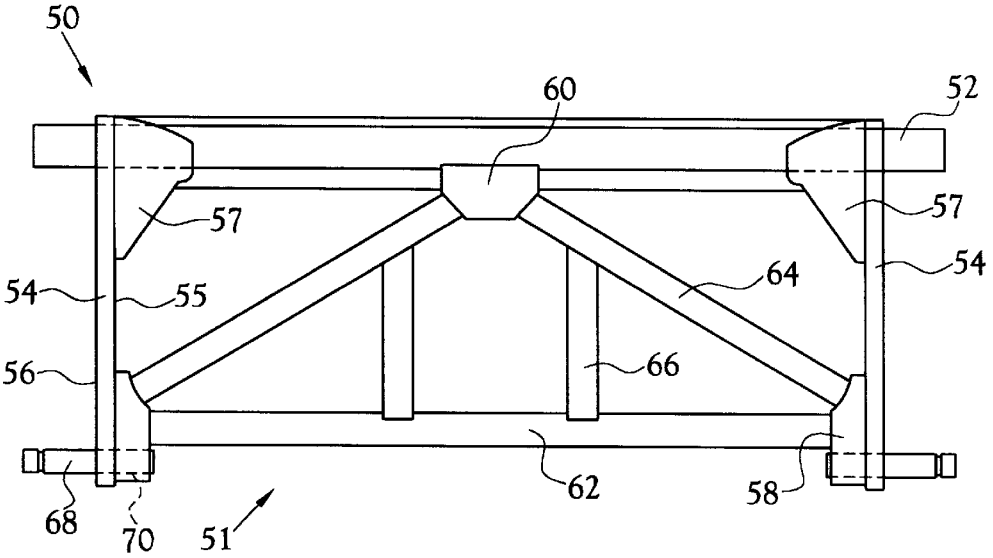
Fig. 2 (PRIOR ART)
FIG. 2 illustrates an end view of the circle and beam assembly of FIG. 1.

A conventional circle and beam assembly 50 is shown in FIG. 1. The circle and beam assembly 50 illustrated is manufactured by Caterpillar Tractor Company. Specifically circle and beam assembly model 14G manufactured for serial numbers 96U1 through 96U6342 inclusive is illustrated in FIG. 1. Caterpillar's model 16G, manufactured for serial numbers 93U1 through 93U2339 inclusive, is illustrated in FIG. 2. Models 14G and 16G are similar in construction with small variances in dimensions. Although several circle assemblies have been developed over the years, Caterpillar motor graders equipped with models 14G and 16G circle and beam assemblies are among the most frequently used.

The circle and beam assembly 50 includes a circle 52 to which a beam assembly 51 is secured, as shown in FIG. 1. The beam assembly 51 includes two beams 54 extending from opposing sides of the circle 52. A brace 57 is secured to an inner surface 55 of each beam 54 and the outer surface 53 of the circle 52. The beam 54 comprising lower supports 58 secured to the inner surface 55 at a lower end thereof, shown most clearly in FIG. 2. An upper support 60 is secured to the circle 52. A beam lower bar 62 extends between the beam lower supports 58 and cross bars 64 extend between each beam lower support 58 to the upper support 60. A strut 66 extends from each cross bar 64 to the lower bar 62 (it will be noted that model 14G does not include the struts). As shown in FIGS. 1 and 2, blade tip bracket hinge pins 68 extend from the outer surface 56 of the each beam 54. Specifically, each pin 68 is secured in a metal casing 72 mounted in an opening 70 defined through the beam 54 and the beam lower support 58. The pins 68 are welded to the beam lower supports 58. The hinge pins 68 are configured to receive the grader blade thereon (not shown).

The area where a grader blade is mounted to the circle and beam assembly 50, i.e. the blade tip bracket hinge pins 68, is where premature failure in the circle assembly is most likely to occur. The blade exerts a tremendous amount of pressure on this area when working in hard conditions. This causes the metal casing 72 around the pin 68 to start stretching and bending. Eventually, the opening 70 is loose on the pin 68 and the weld breaks, allowing the pin 68 to work free. Traditionally, to repair the assembly, the metal casing 72 is repaired and the hinge pin 68 is rewelded.

Figure 4:
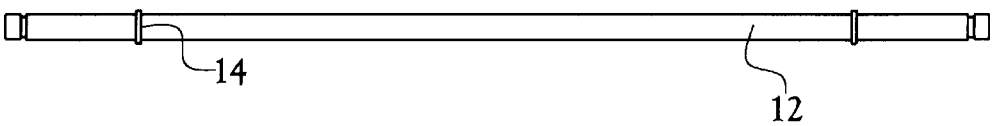

The improved assembly 10, shown in FIG. 3, includes a hinge rod 12 which extends between the beams 54, replacing the hinge pins of the conventional embodiment. The hinge rod 12 is configured to extend from each beam 54 the correct length which is approximately 6½ inches. For Caterpillar model 14G circle and beam assemblies, the total length of the hinge rod is 85¾ inches and for model 16G, the total length of the hinge rod is 86¼ inches. The hinge rod 12 is shown in FIG. 4. In the preferred embodiment, the outer diameter of the hinge rod 12 is configured to be slightly larger than the inner diameter of the openings 70 defined by each of the beams 54 and beam lower supports 58.

To install the hinge rod 12, the openings 70 are heated to allow for expansion and the hinge rod 12 is received therethrough. Upon cooling, the openings 70 shrink around the hinge rod 12 for a very tight fit.

In the preferred embodiment, a flange 14 is used on each inside face of the beam lower support 58. The flange 14 is welded to the hinge rod 12 and then welded around the outside of the flange 14 to the beam lower support 58. The flanges 14 are installed by heating and inserting the hinge rod 12 through one opening 70, placing the flanges 14 on the hinge rod 12 and heating and inserting the hinge rod 12 through the second opening 70. The flanges 14 aid in future repairs to prevent the beam assembly 54 from moving and causing damage to the supports 62, 64 and the beam assembly 54.

The hinge rod 12 reduces premature failure of the improved circle and beam assembly 10 at this location because it acts as a brace from one side of the improved circle and beam assembly 10 to the other. One side of the rod 12 pulls against the other, preventing the rod 12 from working loose or coming out.

From the foregoing description, it will be recognized by those skilled in the art that an improved circle assembly offering advantages over the prior art has been provided. Specifically, the improved circle and beam assembly is configured to prevent premature failure. Moreover, in the improved circle and beam assembly parts of a conventional circle and beam assembly are replaced such that improved circle and beam assembly can be used with the conventional motor grader.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. A circle and beam assembly for mounting a blade of a motor grader comprising:

a circle; and a beam assembly secured to said circle, said beam assembly defining at least two cross bars, a lower bar, two beams and a hinge rod, said two beams depending from opposing sides of said circle, each of said beams defining an opening at a distal end thereof, said hinge rod extending between said two beams and being received through said openings and being rigidly anchored to said two beams at the location of each said openings, said hinge rod being configured to extend beyond each of said beams to define a hinge pin adjacent each of said distal ends of said two beams at a location below and spaced apart from said lower bar for mounting of the blade thereon, a first end of each of said at least two cross bars being secured to a rear portion of said circle, a second end of each of said at least two cross bars being secured to a respective lower end of each of said two beams, said lower bar extending between said two beams and being anchored to said two beams at locations on respective ones of said beams that are disposed above and spaced apart from said openings defined in said beams, said beam assembly further including two flanges carried by said hinge rod, each of said flanges being welded to said hinge rod and an interior face of each of said two beams.

2. A circle and beam assembly for a motor grader comprising:

a circle; and a beam assembly being secured to said circle, said beam assembly defining at least two cross bars, a lower bar, two beams and a hinge rod, said two beams extending from opposing sides of said circle, each of said beams defining an opening at a lower end thereof, said openings defining an inner diameter, said hinge rod defines an outer diameter which is larger than the inner diameter of each of said openings, said hinge rod being insertable through said openings by heating said openings to expand said openings, said openings contracting upon cooling such that said hinge rod is stationary with respect to each of said beams, said hinge rod being configured to extend beyond each of said beams, a first end of each of said at least two cross bars being secured to a rear portion of said circle, a second end of each of said at least two cross bars being secured to a lower end of each of said two beams, said lower bar extending between said lower end of each of said two beams, said hinge rod being positioned below said lower bar; and, two flanges carried by said hinge rod, each of said two flanges being welded to an interior face of each of said two beams, said two flanges being welded to said hinge rod.

3. A circle and beam assembly for a motor grader, the circle and beam assembly including two beams extending from opposing sides of a circle and at least two cross bars and a lower bar, a first end of each of the two cross bars being secured to a rear portion of the circle, a second end of each of the two cross bars being secured to a lower end of each of the beams, each of the two beams defining an opening at a lower end thereof below the lower bar, the improvement comprising:

a hinge rod being received through the openings, said hinge rod being configured to extend beyond each of said beams, said hinge rod being stationary with respect to each of said beams, said hinge rod being positioned below said lower bar, and further including two flanges carried by said hinge rod, each of said flanges being welded to said hinge rod and an interior face of said beam.

* * * * *